US007335005B2

(12) United States Patent
Cottais

(10) Patent No.: US 7,335,005 B2
(45) Date of Patent: Feb. 26, 2008

(54) GEAR PUMP WITH PRESTRESSED GEAR TEETH

(75) Inventor: Frédéric Cottais, Clermont-Ferrand (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 757 days.

(21) Appl. No.: 10/778,224

(22) Filed: Feb. 17, 2004

(65) Prior Publication Data

US 2004/0161357 A1 Aug. 19, 2004

Related U.S. Application Data

(63) Continuation of application No. PCT/EP02/08970, filed on Aug. 9, 2002.

(30) Foreign Application Priority Data

Aug. 16, 2001 (FR) ..... 01 10879

(51) Int. Cl.
*F01C 1/08* (2006.01)
*F01C 1/24* (2006.01)

(52) U.S. Cl. ..... 418/196; 418/206.6

(58) Field of Classification Search ..... 418/189, 418/190, 196, 197, 191, 199, 200, 206.1, 418/206.4, 206.5, 206.6
See application file for complete search history.

(56) References Cited

U.S. PATENT DOCUMENTS 2,088,121 A * 7/1937 Swink ..... 123/232
3,050,009 A * 8/1962 Lowry ..... 418/153
3,297,006 A * 1/1967 Marshall ..... 123/208
3,854,492 A * 12/1974 Kita ..... 137/99
3,941,527 A * 3/1976 Allington ..... 418/196
4,025,056 A 5/1977 Miles et al.
4,145,168 A * 3/1979 Smith et al. ..... 418/150
4,242,067 A * 12/1980 Segerstrom ..... 418/203
5,120,206 A 6/1992 Greenstreet et al.
5,224,838 A 7/1993 Baumgarten
5,297,866 A * 3/1994 Capelle ..... 366/97

FOREIGN PATENT DOCUMENTS

DE 2 321 639 11/1974
FR 1 103 716 11/1955

* cited by examiner

*Primary Examiner*—Thomas Denion
*Assistant Examiner*—Douglas J. Duff
(74) *Attorney, Agent, or Firm*—Buchanan Ingersoll & Rooney PC

(57) ABSTRACT

A gear pump, in particular for pumping material such as rubber mixes, includes an enclosure in which a central gear wheel and two peripheral gear wheels rotate. Teeth of the central gear wheel mesh with teeth of both peripheral gear wheels to pump material from an inlet to an outlet. The pump includes at least one feed chamber in which a feed mechanism delivers material to the inlet. The gear wheels are separately driven by a driving torque. A prestressing device applies a torsional prestress which presses the meshing teeth together for creating a seal between those meshing teeth to prevent leakage of material past the teeth.

11 Claims, 4 Drawing Sheets

GEAR PUMP WITH PRESTRESSED GEAR TEETH

This application is a continuation of International Application Serial No. PCT/EP02/08970 filed on Aug. 9, 2002, which claims priority from French Application Serial No. 01/10879 filed on Aug. 16, 2001, the entire content of which is hereby incorporated by reference.

BACKGROUND OF THE INVENTION

The present invention relates to volumetric pumps intended in particular for rubber mixes and, more particularly, to gear pumps.

It is known to use volumetric gear pumps for high-viscosity plastics materials such as the one described in Greenstreet et al. U.S. Pat. No. 5,120,206. A pump of this type uses a gear system comprising a motorised driving gear wheel, "driving wheel", and a second wheel engaged with the first and driven in rotation thereby, and also a feed screw which makes it possible to force-feed said pump with high-viscosity plastics material.

The rubber mixes also have a very high viscosity, which causes a very great resisting torque on the driving wheel. This resisting torque is all the greater since it is desired to achieve high flow rates by increasing the width of the gear wheels. These difficulties are so great that, in applications of gear pumps to rubber, frequent breakage of the gear wheels is observed.

Furthermore, the achieving of a high flow rate for the rubber mixes is limited by the thermal aspect, because the increase in flow rate, which is mainly a function of the increase in speed of rotation of the gear wheels, is accompanied by a large increase in the temperature of the rubber mixes; now, this temperature must be both controlled and in particular its increase limited in order to avoid early vulcanisation of these mixes.

SUMMARY OF THE INVENTION

The invention aims to overcome all these drawbacks.

According to the invention, the gear pump, in particular for rubber mixes, comprises an enclosure in which rotates a set of gear wheels comprising a central gear wheel which cooperates with other two peripheral gear wheels, said pump comprising at least one feed chamber in which acts at least one feed means for delivering the material to said enclosure via at least one passage orifice, each of the gear wheels being driven directly by a driving torque and prestressing means between the teeth ensuring hermetic contact of the meshing zone of the central wheel with each of the two peripheral wheels.

This arrangement permits, on one hand, the transmission of a driving torque to each gear wheel of the gear system and, on the other hand, better distribution of the forces between the three gear wheels, which makes the pump more reliable and stronger.

According to one characteristic of the invention, the feed chamber comprises two passage orifices towards the enclosure, the two passage orifices being arranged symmetrically relative to the center of the central wheel, and two outlet orifices for the mix which are arranged symmetrically relative to the center of the central wheel such that each passage orifice is arranged substantially symmetrically to an outlet orifice relative to the straight line passant through the center of the three gear wheels projecting into a plane perpendicular to the axes of said wheels.

Thus, the path of the rubber mixes into the enclosure is minimized, which also limits the temperature increases.

DESCRIPTION OF THE DRAWINGS

Other characteristics and advantages of the invention will become apparent on reading an example of embodiment of a volumetric pump according to the invention, with reference to the drawings, in which.

DESCRIPTION OF A PREFERRED EMBODIMENT OF THE INVENTION

Figure 1:
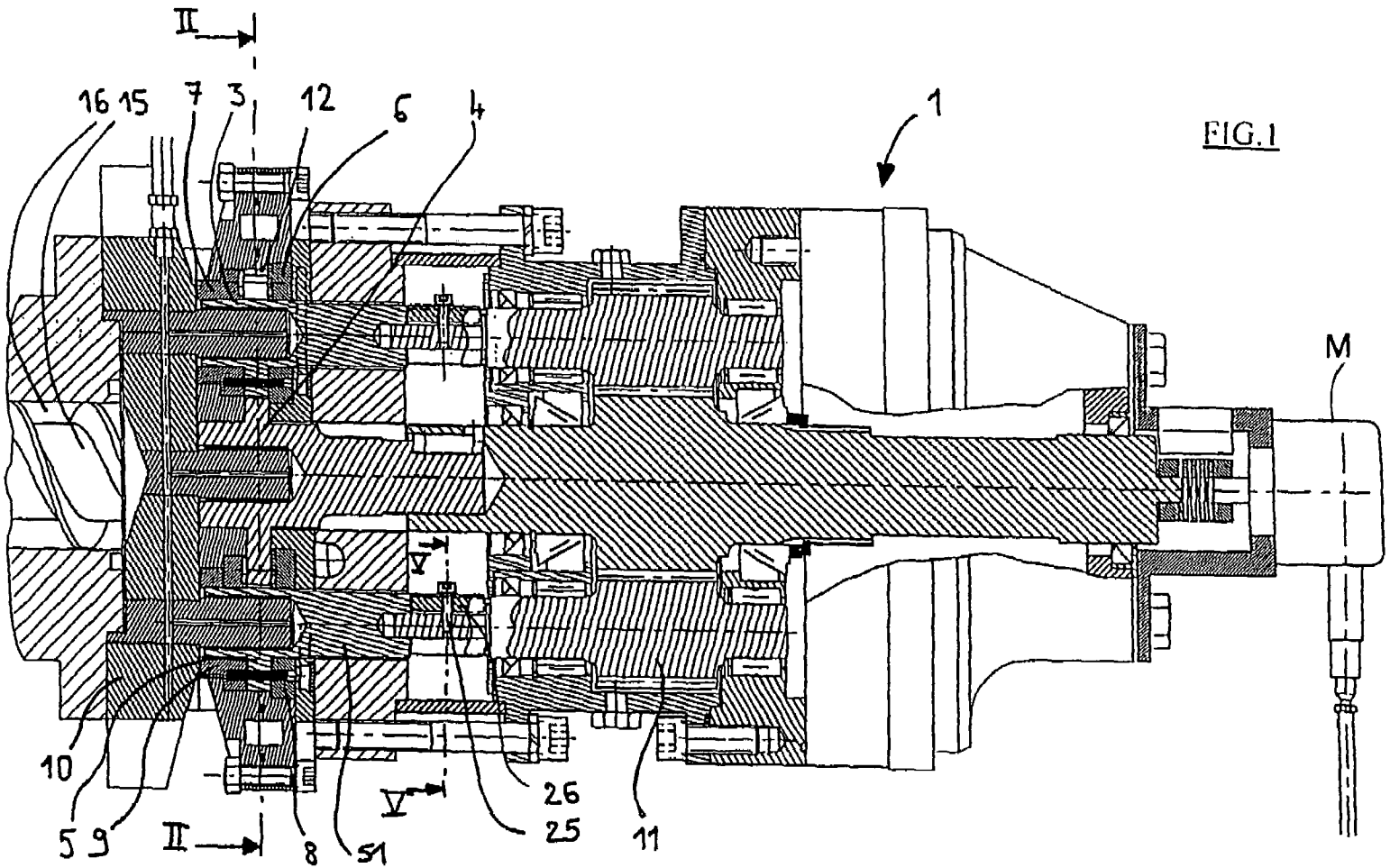
FIG. 1 is a partial longitudinal section through the pump according to the invention along the line I-I shown in FIG. 2.
Figure 2:
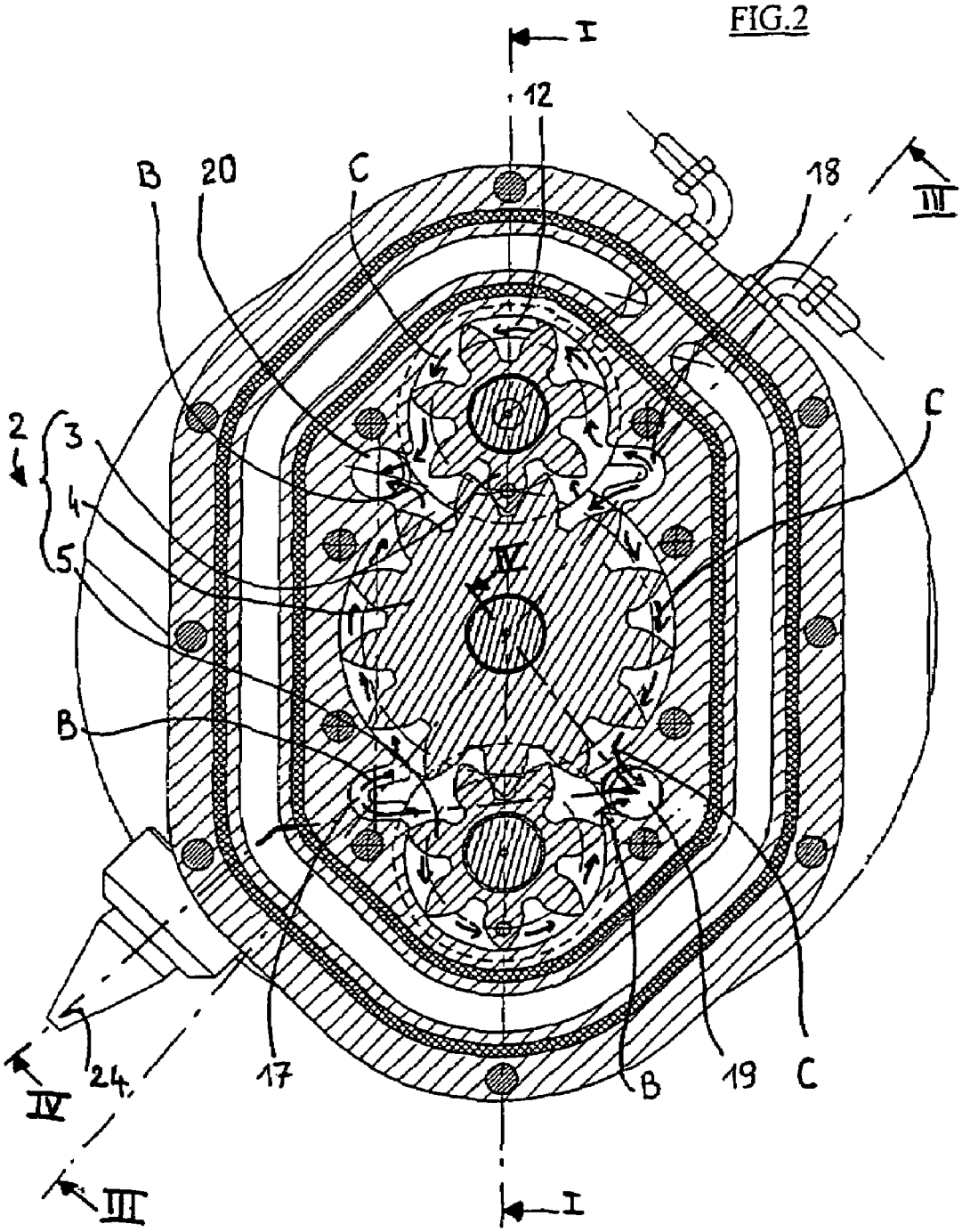
FIG. 2 is an enlarged radial section through the pump according to the invention along the line II-II shown in FIG. 1.

In FIGS. 1 and 2, the gear pump 1 comprises a body 10 comprising an enclosure 12 bearing a set 2 of gear wheels, the function of which is to pump volumetrically.

This set 2 comprises a central gear wheel 4 which cooperates respectively with two peripheral gear wheels 3 and 5.

Each of the two peripheral wheels 3, 5 meshes respectively with the central wheel 4 without however being engaged with the latter, in order to avoid in particular one of the gear wheels being driven by another, because each of the gear wheels 3, 4, 5 is driven directly by a motor M in order to make the pump more reliable, as stated previously. Of course, it is possible to use a single motor with a specific reducing gear to transmit the power to each gear wheel.

The two gear wheels 3 and 5 are arranged symmetrically relative to the center of the central gear wheel 4, which comprises an odd number of teeth. Thus, when considering the central wheel 4, it will be noted that the forces are symmetrical and therefore cancel each other out.

The two peripheral gear wheels 3 and 5 are of identical diameter and on each face of each of its wheels there is positioned a side plate 6 and 7 for the wheel 3 and 8 and 9 for the wheel 5 respectively. These side plates 6, 7, 8, 9, the diameter of which is greater than or equal to that of the end of the teeth of the wheels 3 and 5, enable the lateral shearing of the rubber mixes on the walls of the pump to be prevented, which considerably reduces the shearing exerted on these mixes. Furthermore, the small size of the gear wheels 3 and 5 enables low forces to be produced at the axes.

Furthermore, there are for each peripheral wheel 3, 5 prestressing means between the teeth of the central wheel 4 and respectively the peripheral wheels 3 and 5 which make it possible to produce a dynamic sealing system by cantilevering said wheels 3 and 5.

Figure 5:
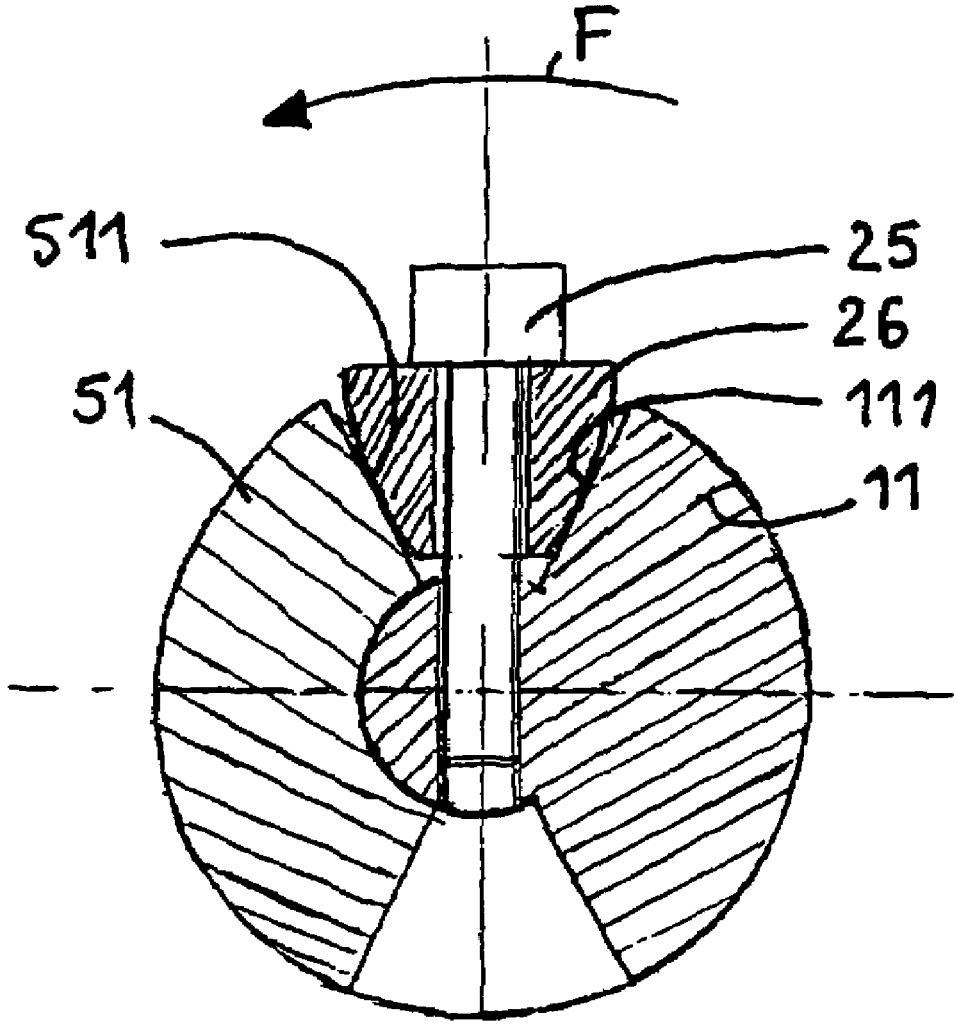
FIG. 5 is a partial section through the prestressing means between the teeth of the pump along the line V shown in FIG. 1.

As the prestressing means acting on the wheels 3 and 5 are identical, only the means acting on the 5 will be described hereafter with reference to FIGS. 1 and 5.

The prestressing means comprise a screw 25 engaged in a passage orifice which passes simultaneously through the shaft 51 of the wheel 5 and the driving shaft 11 which drives the shaft 51. The screw also passes through a domed wedge 26, the domed walls of which are in contact respectively with a wall 111 of the driving shaft and a wall 511 of the shaft 51 such that the clamping of the screw 25 by means of the wedge 26 generates a torsional moment between the driving shaft 11 and the shaft 51. This prestressing acts in the same direction as the rotation of the pump represented by the arrow F.

Rubber mixes escape from the wheels 3 and 5 via outlets located on the side plates 6, 7, 8 and 9 and the azimuth of which is located with precision, as can be seen in FIG. 2.

The body 10 bears a feed means which consists essentially of a screw 15, rotating in a feed chamber 16.

It would be possible, without departing from the scope of the invention, to conceive of a plurality of screws being present opening on to one and the same accumulation chamber.

The feed and pressurization chamber 16 comprises, on the side opposite the set 2 of wheels, a feed orifice (not shown) which serves to feed the pump.

Figure 3:
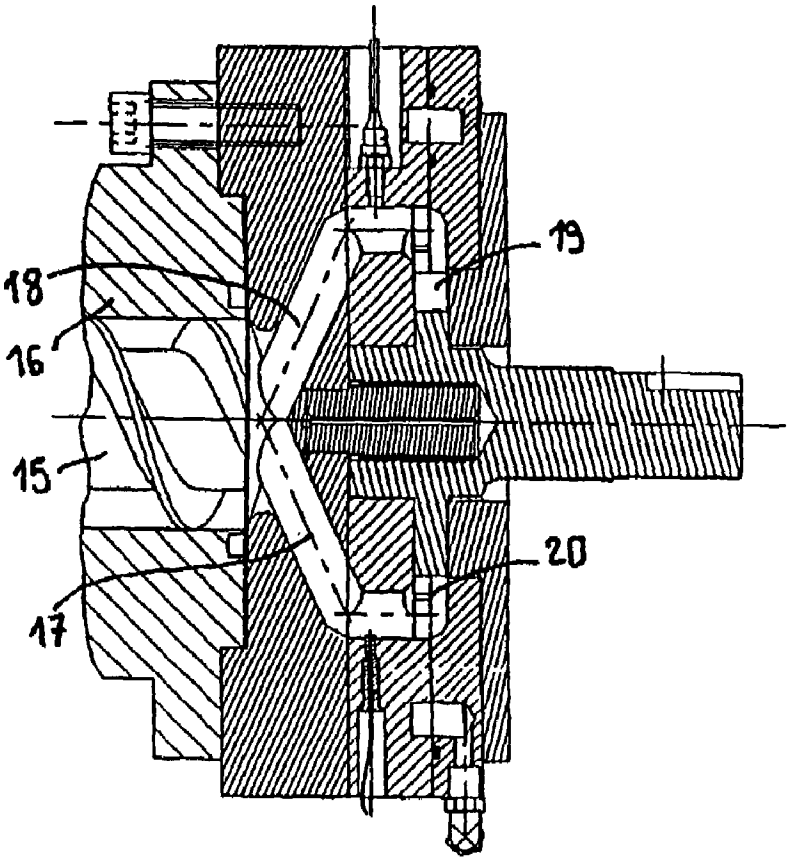
FIG. 3 is a functional section through the feeding zone of the pump according to the invention along the line III shown in FIG. 2.

At the other end of the feed chamber 16, there are located two passage orifices 17, 18 which provide communication between the feed and pressurization chamber 16 and the enclosure 12 containing the set 2 of wheels as seen in FIG. 3.

These passage orifices 17, 18 are arranged symmetrically with respect to each other relative to the center of the central wheel 4 and such that they are respectively arranged close to said central wheel and one of the peripheral wheels.

The enclosure 12 opens on to two outlet orifices for the mix 19 and 20, also arranged symmetrically with respect to each other relative to the center of the central wheel 4, so that they are respectively arranged close to said central wheel and one of the peripheral wheels, such that each passage orifice 17, 18 is arranged substantially symmetrically to an outlet orifice 19, 20 relative to the straight line passing through the center of the three gear wheels 3, 4, 5 projecting into a plane perpendicular to the axes of said wheels.

This arrangement makes it possible to optimize the path traveled by the rubber mix by minimizing it as will be seen more clearly hereafter.

Thus the distance between the zone of entry into the enclosure 12 and the delivery zone is minimal, which also makes it easier to guarantee tightness.

Finally, the shape of the teeth has been optimized to transport the mix within the enclosure 12. The capacity of the tooth axes is as large as possible, whereas the peripheral shearing planes are reduced.

Figure 4:
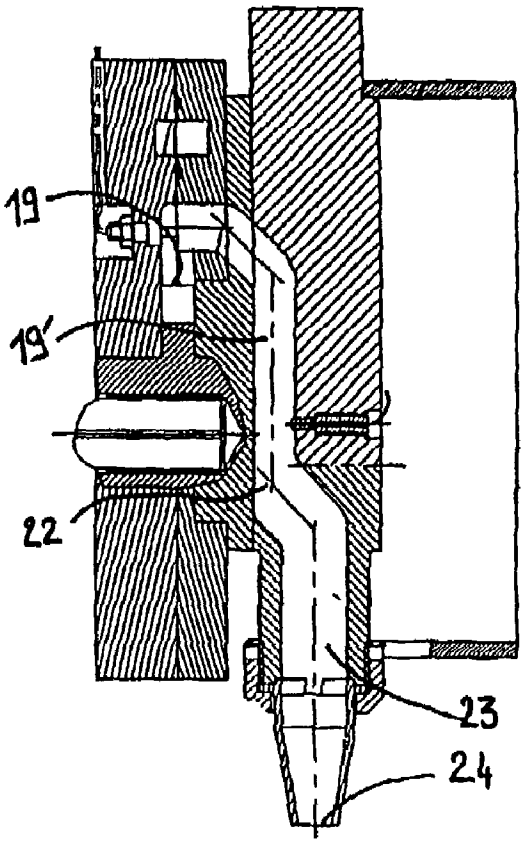
FIG. 4 is a functional section through the delivery zone of the pump according to the invention along the line IV shown in FIG. 2.

The outlet orifices 19 and 20 open respectively into two channels, only the channel 19' corresponding to the orifice 19 being shown in FIG. 4. The two channels join up at the junction zone 22 into a channel 23 extending as far as an outlet orifice 24.

The operation of a gear pump according to the invention such as described previously will be described succinctly hereafter, with reference to FIGS. 2, 3 and 4.

A rubber mix is introduced into the feed chamber 16 via an orifice (not shown), in a form which may be equally well a continuous strip or granules. The mix is thus distributed to the feed screw 15.

In the feed chamber 16, the rubber mix is delivered under pressure as far as the passage orifices 17 and 18, which conduct it into the enclosure 12, opening on to the opposite side relative to the center of the main wheel 4, as shown in FIG. 2.

The two parts of the mix coming out from the orifices 17 and 18 respectively will be designated B and C to follow their path using the arrows shown in FIG. 2.

One part of the mix B thus passes in the dedenda of the peripheral wheel 5 as far as the outlet orifice 19, whereas the other part of the mix B passes in the opposite direction of rotation in the dedenda of the central wheel 4 as far as the orifice 20.

In the same manner, part of the flow of the mix C passes in the dedenda of the peripheral wheel 3 as far as the orifice 20 and the other part in the opposite direction of rotation in the dedenda of the wheel 4 towards the orifice 19.

The prestressed mounting of the teeth of the wheels 3 and 5 respectively in contact with the teeth of the wheel 4 prevents the mix from creeping between the teeth of the wheels 3 and 4 or 5 and 4.

The path traveled by the flows B and C of mix, as can clearly be seen, is fairly short, which considerably limits the temperature increases in this zone.

The flows B and C coming from the outlet orifices 19 and 20 then, as shown in FIG. 4, pass into the channel 19' and the channel (not shown) corresponding to the orifice 20, then the flows join up in the junction zone 22 to flow through the channel 23 to the outlet orifice 24.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A gear pump in particular for rubber mixes, comprising an enclosure in which rotates a set of gear wheels comprising a central gear wheel which cooperates with two peripheral gear wheels, said pump comprising at least one feed chamber in which acts at least one feed mechanism for delivering the material to said enclosure via at least one passage orifice, the gear wheels being separately driven by a driving torque, and prestressing means for pressing the meshing teeth of the central wheel and the peripheral wheels against one another for ensuring hermetic contact of the meshing zone of the central wheel with each of the two peripheral wheels.

2. A pump according to claim 1, in which each peripheral gear wheel comprises two side plates surrounding the wheel, the diameter of these side plates being greater than or equal to that of the ends of the teeth of the wheel in question.

3. A pump according to claim 1 in which the prestressing means comprise, for each peripheral wheel, a screw cooperating by means of a domed wedge with the driving shaft for transmission to the shaft for driving the wheel in question and said drive shaft so as to impose a torsional moment between these two shafts.

4. A pump according to claim 1 in which the two peripheral wheels are arranged symmetrically to the centre of the central wheel, which has an odd number of teeth.

5. A pump according to claim 1 in which the two peripheral wheels have a diameter less than that of the central wheel.

6. A pump according to claim 1 in which the feed chamber comprises two passage orifices towards the enclosure, the two passage orifices being arranged symmetrically to the centre of the central wheel, and two outlet orifices for the mix which are arranged symmetrically to the centre of the central wheel such that each passage orifice is arranged substantially symmetrically to an outlet orifice relative to the straight line passing through the centre of the three gear wheels projecting into a plane perpendicular to the axes of said wheels.

7. A gear pump for pumping material, comprising: an enclosure; a central gear wheel disposed in the enclosure for rotation in a direction of rotation; a peripheral gear wheel disposed in the enclosure and including teeth arranged to mesh with teeth of the central gear wheel in a meshing zone; the meshing zone disposed between an inlet for receiving material to be pumped, and an outlet to which the material is discharged; a motor for generating a drive torque; a drive mechanism arranged to transmit the drive torque separately to the central gear wheel and the peripheral gear wheel; and a prestressing device arranged to apply a torsional prestress between meshed teeth of the central gear wheel and the peripheral gear wheel to create a seal at the meshed teeth which resists the leakage of material between the meshed teeth.

8. A pump according to claim 7 further including a driving shaft for transmitting drive torque to a shaft portion of the peripheral gear wheel, the prestressing device disposed between the drive shaft and the shaft portion.

9. A pump according to claim 8 wherein the prestressing device comprises a wedge arranged to engage respective surfaces of the driving shaft and the shaft portion.

10. A pump according to claim 7 further including an additional peripheral gear wheel having teeth arranged to mesh with the teeth of the central gear wheel, and an additional prestressing device arranged to provide a torsional prestress between meshed teeth of the central gear wheel and the additional peripheral gear wheel to create a seal at those meshed teeth.

11. A gear pump in particular for rubber mixes, comprising an enclosure in which rotates a set of gear wheels comprising a central gear wheel which cooperates with other two peripheral gear wheels, said pump comprising at least one feed chamber for delivering the material to said enclosure via at least one passage orifice, each of the gear wheels being driven separately by a respective driving shaft, and prestressing means for placing in prestressed contact the teeth of the peripheral wheels with the teeth of the contact wheel for ensuring hermetic contact of the meshing zone of the central wheel with each of the two peripheral wheels, the prestressing means comprising, for each peripheral wheel, a screw cooperating by means of a domed wedge with the respective driving shaft and the respective peripheral wheel to impose a torsional moment between these two shafts.

* * * * *